United States Patent [19]

Sheesley

[11] Patent Number: 4,557,079

[45] Date of Patent: Dec. 10, 1985

[54] SPIN BLASTER

[75] Inventor: Gary Sheesley, Levittown, Pa.

[73] Assignee: Empire Abrasive Equipment Corporation, Langhorne, Pa.

[21] Appl. No.: 623,070

[22] Filed: Jun. 22, 1984

[51] Int. Cl.[4] ..... B24C 3/06

[52] U.S. Cl. ..... 51/411; 51/436

[58] Field of Search ..... 51/411, 428, 429, 436, 51/439; 118/317; 134/166 C, 167 C, 168 C, 169 C

[56] References Cited

U.S. PATENT DOCUMENTS

| | | | |
|---|---|---|---|
| 1,953,311 | 4/1934 | Peik | 51/439 |
| 2,358,557 | 9/1944 | Boyd et al. | 51/411 |
| 3,137,974 | 6/1964 | Kirkland | 51/411 |
| 3,835,587 | 9/1974 | Hall . | |
| 3,902,276 | 9/1975 | Jarvis | 51/411 |
| 4,314,427 | 2/1982 | Stoltz | 51/411 |
| 4,439,954 | 4/1984 | Bennett | 51/411 |

FOREIGN PATENT DOCUMENTS

| | | |
|---|---|---|
| 250097 | 6/1968 | Australia . |

*Primary Examiner*—Robert P. Olszewski

*Attorney, Agent, or Firm*—Sperry, Zoda & Kane

[57] ABSTRACT

Apparatus for blast-cleaning the interior surface of a pipe includes a main housing that travels the length of the pipe, and rotatably supports a blast nozzle. A nozzle support shaft carried by the housing rotates freely, reactively to air carrying abrasive media and forced through the nozzle under high pressure. Since the air is directed through a non-rotating conduit to the shaft, a gasket is interposed between the rotating and non-rotating components. To prevent the abrasive media from penetrating the shaft support bearings of the housing with obviously destructive effects, a gap is maintained between the housing and a junction housing in which the non-rotating conduit is mounted. Leakage that does occur past the gasket is dispersed to the ambient atmosphere through the gap, before it can impinge upon the bearings. The non-rotating conduit is threadedly advanceable within the junction housing, so as to correspondingly, selectively adjust the extent to which the gasket is compressed. In each position to which the conduit is selectively adjusted, it can be locked, to preserve the adjusted compression of the gasket.

2 Claims, 5 Drawing Figures

SPIN BLASTER

BACKGROUND OF THE INVENTION

1. Field Of The Invention

The present invention relates generally to blast cleaning systems used for cleaning surfaces by the abrasive action of sand or other abrasive media borne by a carrier fluid which is typically compressed air, forced against the surface to be cleaned under high pressure. In a more specific sense, the invention relates to blast-cleaning devices designed to clean the interior surfaces of pipes. These are often mounted on traveling carriages that are moved through the pipes to be cleaned, and which have blast nozzles rotating at high speed in reaction to the force of the carrier fluid supplied to the nozzles as the device moves along the length of the pipe.

2. Description Of The Prior Art

Heretofore, it has been well known to provide traveling carriages, that move through the length of a pipe or other tubular object that is to be cleaned, with said carriages being adapted to support high speed, rotating nozzles through which compressed air is directed, against the surface of the pipe. In devices of this type, abrasive media are carried by the air, sand being a typical medium used for the purpose of cleaning the internal surface of the pipe.

In devices of this type, the nozzle rotates reactively to the force of the compressed air directed therethrough. It is common, further, for the compressed air to be supplied to the traveling device, through a hose, to a non-rotatable conduit.

In devices of this type, as a result, problems arise resulting from the fact that it is necessary to supply the compressed air under high pressure first through a non-rotating conduit, and then to a freely rotatable nozzle support shaft mounted in the housing supported on the traveling carriage. The basic problem in apparatus of this type is that a sealing gasket must be employed between the rotating and non-rotating components, and this gasket obviously becomes subject to heavy wear, by reason of the fact that the compressed air is supplied under high pressure, and further by reason of the fact that the compressed air carries abrasive media which is forced against the gasket, tending to cause deterioration of the gasket with undesirable rapidity.

Usually, a leather seal or gasket is employed between the rotating and non-rotating members. It has been found, in the art to which the invention is directed that maintaining exactly the right pressure on the seal is a highly critical requirement. If excessive pressure is used, the rotating member is prevented from spinning with the freedom requisite to proper operation of the cleaning system.

Conversely, if too little pressure is exerted upon the seal, an excessive amount of abrasive and air leaks through the joint between the rotating and non-rotating members. It has been proposed, in this regard, that once the tightness of the rotating joint is judged to be correct, after threadedly advancing the non-rotating conduit against the seal to compress it to the desired extent, one can lock the conduit in the position to which it is threadedly advanced, and in this way preserve the adjustment. The problem, however, is that during regular operation the rotation of the nozzle support shaft causes rapid wear of the seal, requiring frequent re-adjustments.

Commonly, the rotation seal, and the bearings and bearing seals of the nozzle support shafts, are all enclosed in a common housing. The known tendency of leakage of abrasive past the seals results in penetration of the bearings and bearing seals by the abrasive, with obviously destructive effect thereon. It is common, indeed, to remove and clean the bearings at the end of every work shift.

It has been proposed to provide an air gap to permit dispersal of the leaking abrasive to the ambient atmosphere, so as to prevent it from penetrating the bearings and bearing seals of the nozzle support shaft. However, so far as is known, a completely satisfactory result has not been obtained in devices heretofore making use of this concept, by reason of the fact that the only way in which pressure on the sealing gasket has been adjusted, when a gap open to ambient atmosphere is used, is by adjusting the width of the gap through the use of shims that must be added or removed according to the needs of the particular situation. This is an undesirably cumbersome procedure, and even when employed, does not necessarily assure the precise, fine adjustments of pressure that should desirably be embodied in a spin blast apparatus of the type described previously herein.

SUMMARY OF THE INVENTION

Summarized briefly, in the present invention there is provided a main housing, which is adapted to be mounted upon a traveling carriage. The traveling carriage can itself be varied, and does not comprise part of the present invention.

The housing is of tubular formation, having an end-to-end bore in which there is freely rotatable a nozzle support shaft, the ends of which project beyond the opposite ends of the housing bore. In order to assure maximum freedom of rotation of the shaft, there are provided bearings in recesses formed in the housing, in communication with the bore. The bearings are protected by bearing seals, and end plates are applied to the respective, opposite ends of the housing, to assure that the bearings are properly enclosed and positioned, and also to minimize the penetration of the bearings by grit, dust, or dirt.

The nozzle support shaft, at its head end, is connectable to a nozzle, which itself is of conventional design, and is adapted to be spun or rotated at high speed, by the reactive force of compressed air directed therethrough. The compressed air is adapted not only to rotate the nozzle at high speed, but also has, as a primary function, the characteristic of being a carrier fluid for abrasive media, such as sand, grit, or the like.

Thus, as the device travels through the length of a pipe to be cleaned, with the carrier fluid being supplied at high pressure to the nozzle through the nozzle support shaft, the nozzle is caused to rotate, forcing streams of compressed air, with abrasive media carried thereby, against the interior surface of the pipe, so that the pipe is cleaned during the travel of the apparatus from end-to-end thereof.

The compressed air is supplied to the nozzle support shaft and the nozzle through an elongated hose, which follows the device as it moves through the pipe, and the hose is connected to a non-rotating conduit, carried by a junction housing disposed in spaced relation to the rear end of the main housing. The junction housing is connected to the main housing in such a way as to provide a constant gap, the width of which requires no adjustment throughout the life of the device. Through this gap air leaking through the joint between the rotating and non-rotating components of the device is adapted to be dispersed to atmosphere, before it can penetrate the bearing seals and bearings. Such penetration, as will be understood, would have an obviously destructive effect upon the bearings and their associated seals, requiring frequent replacement of the bearings with consequent loss of time and, of course, resulting great expense.

In accordance with the invention, a gasket or seal is interposed between the non-rotating air supply conduit, and the freely rotatable nozzle support shaft. The gasket is provided in a counter bore of the junction housing, in facing relation to the dispersal gap. It is important, as already known in the art, to provide for precise adjustment of the compression of the gasket, to assure free rotation of the nozzle support shaft while at the same time minimizing leakage through the joint between the rotating and non-rotatable components of the device.

Accordingly, in the present invention there is used, in the junction housing, a threadedly advanceable air supply conduit, the end of which abuts directly against a carbide washer which in turn abuts against the gasket. By threaded advancement of the conduit, pressure against the gasket or joint seal is precisely, finely adjusted to the exact extent needed to minimize leakage while permitting free rotation of the nozzle support shaft. Then, after the adjustment is made the conduit is lockable in position so as to preserve the adjustment.

In accordance with the invention, this adjustment is made in such a way as to eliminate the necessity of adding or removing shims or spacers, or varying the width of the gap in any way. The gap is maintained constant, and all adjustments of the pressure against the seal are effected merely by threaded advancement of the conduit, and locking of the conduit in selected positions to which it is advanced or, possibly, retracted.

The invention thus combines a non-varying, spaced relationship between the junction housing and the main housing, with an axially adjustable, non-rotating supply conduit and rotating nozzle support shaft, in such a way as to permit precise adjustments of the seal between the rotating and non-rotating parts, while at the same time assuring that the pressure against the seal is exerted exactly where it will produce optimum results, namely, in the exact area where the seal is interposed between said rotating and non-rotating components for the prevention of leakage through the joint between them.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 4:
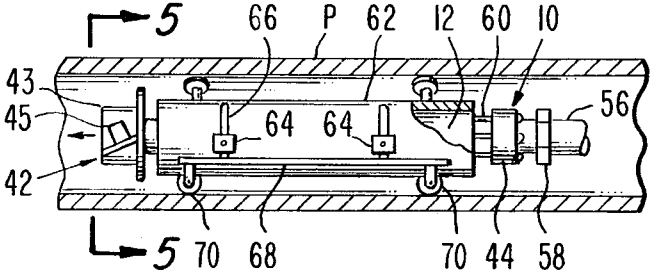
FIG. 4 is a view on a reduced scale showing a pipe fragmentarily and in longitudinal section, the device constituting the present invention being illustrated within the pipe partly in side elevation and partly in longitudinal section, as it appears when mounted upon a traveling carriage for passage through the pipe.
Figure 5:
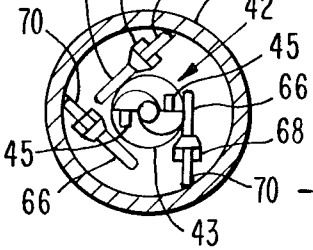
FIG. 5 is a transverse sectional view substantially on line 5—5 of FIG. 4.

Referring to the drawing in detail, the reference numeral 10 generally designates a spin blaster, used for the purpose of cleaning the interior surface of a pipe designated P in FIGS. 4 and 5.

The spin blaster comprising the present invention includes, in the presently preferred embodiment thereof, an elongated, tubular main housing 12 having an end-to-end, axial bore 14 communicating with a rear bearing recess 16 and a front bearing recess 18 formed in the housing and opening upon the respective ends thereof.

Mounted in the recesses 16, 18 and 22, are bearings and their associated seals, which in and of themselves are conventional and need no special description other than to note that there is a rear bearing 20 mounted in recess 16, and protectively enclosed within the recess through the provision of a plurality of bearing seals 24. The bearing and the bearing seal means illustrated are held in place by a rear end plate 26.

At the other end of the housing, there is provided a brake housing 17. Between the brake housing 17 and housing 12 is a front bearing retainer plate 19.

Formed in housing 12 is a recess 22 in which is mounted a front end bearing 28. Formed in the brake housing is a recess 18 which contains a centrifugal brake 30, disposed in side-by-side relation to a plurality of front end seals 32. A front end plate 34 is applied to hold the several front end seals in place, and is secured to the front end of the housing by a plurality of angularly spaced screws 36 passing through plate 34, brake housing 17, and plate 19 and threadedly engaged in recesses 37 of housing 12.

The bearings, bearing seals, and centrifugal brake are in and of themselves conventional, so as to eliminate the necessity of detailed description thereof. Their particular arrangement, further, can be varied if desired, so long as the brake can act to properly control the rotational speed of the nozzle of the device, by application of suitable braking force to the nozzle support shaft 38.

The nozzle support shaft 38 is journaled in the front and rear end bearings, and has its opposite ends projecting beyond the respective, opposite ends of the housing 12. The nozzle support shaft 38, in the illustrated embodiment, is formed with an axial, end-to-end flow passage 39, through which the carrier fluid, usually compressed air, is directed under heavy pressure.

The projecting front end 40 of the shaft 38 is threaded, for connection of a nozzle 42 thereto. The nozzle 42 is, per se, conventional, and needs no special description or illustration other than to note that it is a nozzle of the type which reacts to the force of a fluid (such as compressed air) directed thereto, in such a way as to cause the nozzle to spin at high speed when the fluid is forced out of the nozzle radially outwardly against the interior surface of the pipe P to be cleaned.

As used herein, the "nozzle" 42 shall be regarded as including both a spin head 43 threadedly connected to the tubular shaft 38, and a pair of nozzle elements 45 threaded into openings provided therefor in the spin head (see FIGS. 4 and 5).

Rotation of the nozzle under the reactive force of the compressed air, thus, causes the nozzle support shaft 38 to be rotated at the high speed under the control, of course, of the centrifugal brake which assures that the speed does not exceed a pre-determined maximum velocity.

In accordance with the invention, there is provided a junction housing 44 axially, rearwardly spaced from the rear end of the main housing to define a gap therebetween through which compressed air and abrasive media leaking through the joint between the rotating and the non-rotating components of the device may be dispersed to ambient atmosphere. The junction housing 44 has a central opening 46 therethrough, and the opening is threaded for at least part of its length. In the illustrated embodiment, the rear end portion of the opening is threaded, and merges at its front end into a smooth walled counter bore 48. Counter bore 48 opens upon the space between the main and junction housings, and seated therein is a washer 50 of metallic material, preferably a carbide washer in a working embodiment of the device. Seated against the carbide washer is a leather seal or gasket 52, the washer and the gasket having openings of the same diameter as the passage 39.

The rearwardly projecting end of the nozzle support shaft 38 extends fully across the space between the main and junction housings, and abuts against the leather seal or gasket 52.

Figure 1:
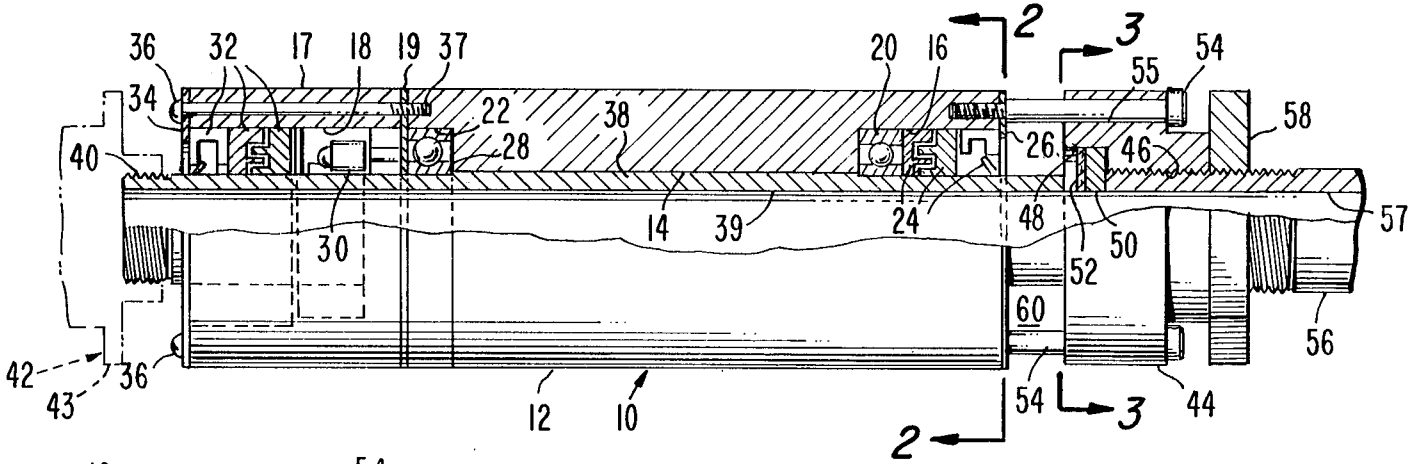
FIG. 1 is a view, partly in longitudinal section and partly in side elevation, of a spin blaster formed in accordance with the present invention, a rotating nozzle being shown fragmentarily and in chain-dotted outline, the carrier fluid supply conduit being partly broken away.
Figure 3:
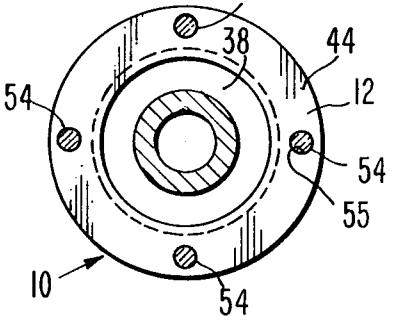
FIG. 3 is a transverse sectional view substantially on line 3—3 of FIG. 1, a portion being broken away, looking toward the junction housing.
Figure 2:
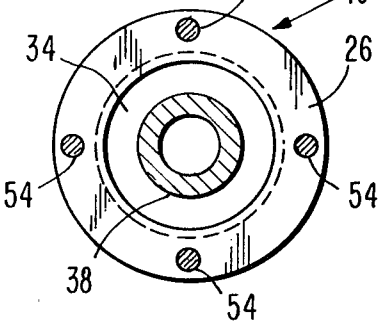
FIG. 2 is a transverse sectional view through the apparatus substantially on line 2—2 of FIG. 1, looking toward the main housing.

As shown in FIGS. 1 and 3, a connecting means is provided, for joining the junction housing and the main housing in a predetermined, axially spaced relationship. For this purpose there are provided angularly spaced screws 54. In the illustrated embodiment, there are four screws, spaced 90° apart (see FIG. 3), the screws extending through smooth walled openings 55 formed in the junction housing. The screws extend across the space between the junction housing and the main housing, and have shoulders bearing against the end plate 26. At their leading ends, the screws have threaded portions that are engaged in threaded recesses of the rear end of the main housing 12.

By reason of this arrangement, it will be seen that with the rearwardly projecting end of the nozzle support shaft 38 bearing against the leather seal 52, the screws 54 can be turned home, to connect the junction housing to the main housing in the desired, spaced relationship thereto. The space, or more properly the width of the space, between the main and junction housing are predetermined, by reason of the fact that the projecting rear end of the shaft 38 bears against the seal 52 and in this way prevents the junction housing from moving out of its predetermined, spaced, unvarying relationship to the main housing.

When this connection is initially made, the leather seal 52 is not under any appreciable pressure. In other words, the junction housing is connected to the main housing, with the nozzle support shaft 38 abutting against the seal 52, in such a manner as to initially leave the seal 52 basically uncompressed. Once this connection is made, and in a manner to be described hereinafter, gasket or seal 52 can be precisely selectively adjusted as to the compression thereof, to assure for free rotation of the shaft 38 while at the same time assuring as much as possible against leakage of air with abrasive media, past the gasket.

Carried by the junction housing is a carrier air supply conduit 56. Conduit 56 is externally threaded, for engagement in the threaded portion of the opening 46. Conduit 56 projects rearwardly from the junction housing, and as will be understood, can be connected to an air blast hose, not shown, leading from an air blast generator, also not shown.

The conduit 56, at its leading end, bears against the carbide washer 50. The conduit, when abutted against the carbide washer 50, is thus brought into free and open communication with the passage 39, seal 52, washer 50, and the bore 57 of the conduit, all being of the same diameter and in full axial alignment.

By reason of this fact, it will be seen that when the conduit 56 is advanced toward the nozzle support shaft, through the medium of the washer 50 it will compress the gasket 52 between the washer and the nozzle support shaft. This compression will occur exactly at the point where it is most needed, that is, at the point through which leakage would develop through the joint between the conduit and the nozzle support shaft. This would be the area completely surrounding the center opening of the seal.

Thus, with the junction housing and main housing already connected in a predetermined spaced relationship, and with the gasket 52 initially under little or no compression at the time this connection of the housings is made, the conduit 56 can be threadedly advanced, to the precise extent necessary to assure continued free rotation of the shaft 38, while at the same time assuring as much as possible against leakage of the carrier fluid and the abrasive media carried thereby, past the joint between the rotating and non-rotating components 38, 56 respectively.

Once the adjustment has been made, a locking collar 58, threaded on the conduit 56, can be advanced into binding engagement with the rear face of the junction housing, so as to lock the conduit 56 in the selected position of threaded advancement. The conduit 56 is also, at the same time, locked against any rotation during the normal operation of the apparatus.

As leakage develops, which it inevitably does due to the fact that the shaft 38 is rotating thereagainst, the escaping air and abrasive is dispersed through the gap 60 to the ambient atmosphere. The gap is completely open to ambient, in the area surrounding the nozzle support shaft, thus assuring to the maximum extent against penetration of the bearing seals 24 and consequent destruction of those seals and the bearing 20 protected thereby.

In this connection, as leakage develops, it is only necessary to back off the locking collar slightly, threadedly advance the conduit 56 to whatever extent is necessary to prevent the leakage while still allowing free rotation of shaft 38, and then once again lock the conduit 56 in the new, selected position of threaded adjustment. This can be carried on at periodic intervals, to whatever extent is necessary to assure a proper seal in the joint between the rotating and non-rotating parts. Ultimately, of course, the seal 52 may need replacement, and this is effected readily and in minimum time.

To replace the seal 52, it is only necessary to remove the screws 54, after which the seal 52 will be completely exposed by separation of the junction housing from the main housing and nozzle support shaft 38. The seal 52 can then be replaced, and the parts can be swiftly reassembled in the manner shown in FIG. 1, with the conduit 56 once again being threadedly adjustable to place the seal 52 under a selected, precisely needed compression.

During the normal use of the device, it appears as in FIGS. 4 and 5. As there shown, the device previously illustrated and described herein is mounted upon a traveling carriage. The carriage itself constitutes no part of the present invention, but is illustrated to show the normal usage of the apparatus. Thus, the carriage includes an elongated sleeve 62, which receives the main housing 12. Sleeve 62 is provided, at uniformly, angularly spaced distances thereabout, with mounting blocks 64. These have bores receiving wheel support bars 66, which are adjustable in the direction of their lengths within the blocks 64, and which are then secured in the selected positions to which they are so adjusted. Carried by the bars 66 is a plate 68 from which depend wheels 70 which rollably contact the internal surface of the pipe to be cleaned. The adjustment of the bars 66 within their associated mounting blocks 64 permits the carriage to be selectively adjusted for differing internal pipe diameters.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. In a spin-blast device of the type in which a nozzle is rotated by the reactive force of a carrier fluid under pressure and thereby blast-cleans the interior surfaces of tubular objects with streams of abrasive media carried by said fluid, the improvement that comprises:

(a) a main housing having an end-to-end bore;

(b) a nozzle support shaft having a longitudinal passage for the carrier fluid, the shaft rotating in the bore, and having means at one end for attaching the nozzle thereto;

(c) a junction housing aligned axially with the main housing and having a center opening;

(d) a non-rotatable carrier fluid supply conduit mounted in the opening end-to-end with the shaft to provide a path along which the carrier fluid flows to the nozzle;

(e) at least one gasket sealably compressed between the shaft and conduit;

(f) means connecting the main and junction housings in spaced relation to provide a gap through which carrier fluid and abrasive media leaking past the gasket may be dispersed to ambient atmosphere;

(g) means for selectively adjusting the compression of the gasket, the conduit being threadedly engaged in the opening of the junction housing for advancement toward and away from the shaft so as to provide said means for adjusting the compression of the gasket; and (h) a locking collar threadedly engaged with the conduit for advancement into locking engagement with the junction housing whereby to preserve selected threaded adjustments of the conduit within the opening of the junction housing.

2. In a spin-blast device of the type in which a nozzle is rotated by the reactive force of a carrier fluid under pressure and thereby blast-cleans the interior surfaces of tubular objects with streams of abrasive media carried by said fluid, the improvement that comprises:

(a) an elongated, tubular, main housing having an axial, end-to-end bore and formed at opposite ends of the bore with bearing and bearing seal recesses communicating with said bore;

(b) bearings and bearing seals mounted in the respective recesses;

(c) a tubular nozzle support shaft extending through said bore and journalled in said bearings to rotate freely within the housing, the opposite ends of the shaft projecting beyond the respective, opposite ends of the main housing, one end of the shaft being adapted for mounting of a nozzle thereon, said shaft having an axial passage for said carrier fluid opening upon the respective ends of the shaft;

(d) a junction housing spaced from the main housing in axial alignment therewith, said junction housing having a center opening aligned with said passage and a counterbore in the center opening facing toward the main housing and receiving said projecting other end of the nozzle support shaft, the center opening being threaded for at least part of its length;

(e) a series of removable connecting elements extending across the space between the housings and connecting the same in their spaced relationship;

(f) a carrier fluid supply conduit threadedly engaged in said center opening in axial alignment with the shaft, so as to be threadedly adjustable toward the shaft to an extent selectable by a user, said conduit and the passage of said shaft communicating to provide a flow path for carrier fluid enroute to the nozzle;

(g) means for locking the conduit in selected positions of threaded adjustment and against rotation; and (h) a gasket seated in the counterbore and compressibly engaged between the locked, non-rotatable conduit and the freely rotatable shaft so as to provide a seal therebetween, said space between the housings defining a gap into which carrier fluid leaking past the gasket may be dispersed into the ambient atmosphere without penetrating the bearing and bearing seals in which said other end of the shaft is journalled, said threaded adjustment of the conduit being adapted to correspondingly adjust the extent to which the gasket is compressed between the shaft and conduit.

* * * * *